United States Patent [19]

Falls et al.

[11] Patent Number: 4,762,178

[45] Date of Patent: Aug. 9, 1988

[54] OIL RECOVERY WITH WATER CONTAINING CARBONATE SALT AND $CO_2$

[75] Inventors: Andrew H. Falls, Sugarland; Myron I. Kuhlman, Houston, both of Tex.

[73] Assignee: Shell Oil Company, Houston, Tex.

[21] Appl. No.: 99,649

[22] Filed: Sep. 24, 1987

Related U.S. Application Data

[63] Continuation of Ser. No. 928,123, Nov. 7, 1986, abandoned.

[51] Int. Cl.[4] ..... E21B 43/22

[52] U.S. Cl. ..... 166/268; 166/279; 166/902; 252/8.554; 252/8.555

[58] Field of Search ..... 166/268, 274, 902, 279, 166/310, 271; 252/8.554, 8.555

[56] References Cited

U.S. PATENT DOCUMENTS

| | | | |
|---|---|---|---|
| 2,398,123 | 4/1946 | Sowers | 166/268 |
| 2,654,436 | 10/1953 | Carlisle et al. | 166/310 |
| 2,875,833 | 3/1959 | Martin | 166/268 |
| 2,884,067 | 4/1959 | Marken | 166/310 X |
| 2,964,109 | 12/1960 | Martin | 166/273 |
| 4,476,930 | 10/1984 | Watanabe | 166/902 X |
| 4,602,920 | 7/1986 | Diaz et al. | 166/267 X |

*Primary Examiner*—Stephen J. Novosad

[57] ABSTRACT

In a carbonated waterflood oil recovery process the corrosivity of a premixed solution is reduced by dissolving the $CO_2$ in water containing enough sodium carbonate or bicarbonate to maintain a pH of at least about 4.

17 Claims, 1 Drawing Sheet

OIL RECOVERY WITH WATER CONTAINING CARBONATE SALT AND $CO_2$

RELATED APPLICATION

This is a continuation of application Ser. No. 928,123, filed Nov. 7, 1986, now abandoned.

The assignee's copending application Ser. No. 928,212, "Carbonate Containing $CO_2$ Foam for Enhanced Oil Recovery," which lists as the inventor A. H. Falls, is relevant to this application, now U.S. Pat. No. 4,733,727.

BACKGROUND OF THE INVENTION

The invention relates to an oil recovery process in which oil is displaced by injecting a mixture of $CO_2$ and aqueous liquid. More particularly, the invention relates to pre-forming such a mixture for coinjection in a manner significantly reducing its corrosivity, by including in the mixture an effective amount of dissolved monovalent cationic salt of carbonic acid.

In one aspect, the present invention provides an improved way of conducting the process of the type described in U.S. Pat. No. 2,875,833. That patent relates to an oil recovery process in which oil is displaced by injecting an aqueous solution which is substantially saturated with respect to carbon dioxide. In the present process, however, the saturated $CO_2$-solution can be mixed in any proportion with undissolved $CO_2$ (e.g., it includes a so-called $CO_2$ water alternate gas (WAG) process).

As stated in Enhanced Recovery Week (ERW), Sept. 9, 1985, "Carbonated waterflooding was largely dropped as an enhanced oil recovery (EOR) technique after initial investigations in the 1950s and Amoco's projects may be signaling a revival of interest (ERW, 4/29/85)". In the Nov. 25, 1985 ERW, it is indicated that Shell Western E & P plans a carbonated waterflood in the South Wasson Clear Fork Unit of the Wasson 72 field, making it the second company planning a carbonated waterflood. But, it is stated that, "Instead of injecting highly corrosive carbonated water, Shell will alternate small $CO_2$ slugs with large water slugs, which will combine in the near wellbore reservoir into carbonated water."

The corrosivity of carbonated water is well known. U.S. Pat. No. 2,964,109 describes a utilization of carbonated water for acidizing a wellbore to remove a skin or layer formed during the drilling of the well. In that process carbon dioxide and water are injected into the well and held there under pressure until the pressure in the well begins to drop rapidly indicating a disintegration of the skin. Papers SPE 10685 and Canadian Institute of Mining (CIM) 83-34-17 discuss the dissolution of calcareous sandstones and carbonates by carbonated water.

The National Association of Corrosion Engineers Basic Corrosion Course, 1973, indicates that condenser corrosion is usually the result of dissolved carbon dioxide. It states that, "The $CO_2$ is released from carbonates in the boiler and being volatile passes through the turbine into the condenser where it dissolves in the water, producing a low pH (acid conditions)." Such conditions cause thinning and grooving of the tubes if protective measures are not taken. And, the usual remedy is indicated to be making the solution alkaline to about pH 8.5 to 8.8 by additions of ammonia-type compounds such as morpholine or cyclohexylamine.

SUMMARY OF THE INVENTION

The present invention improves an oil recovery process in which a mixture of $CO_2$ and aqueous liquid is flowed through conduits that may be corrosion-prone and injected into a subterranean reservoir that itself may be soluble or may contain grain cementing materials which are soluble in carbonic acid, in order to displace the oil. The present invention is thus a process for injecting such a mixture into a subterranean reservoir while reducing its corrosive effects without reducing its beneficial effects. The improvement comprises mixing the $CO_2$ with an aqueous liquid containing enough dissolved monovalent cationic salt of carbonic acid to provide a pH which is at least about 4 but is insufficient to cause precipitation of multivalent carbonate salts at the pressure and temperature attained by the solution at substantially the depth of the reservoir formation. The $CO_2$ which is mixed with the aqueous liquid can be all or partly dissolved in that liquid and can include $CO_2$ in a $CO_2$-rich phase of the mixture in which at least some of the $CO_2$ is gaseous, supercritical or liquid.

DESCRIPTION OF THE INVENTION

Figure 1:
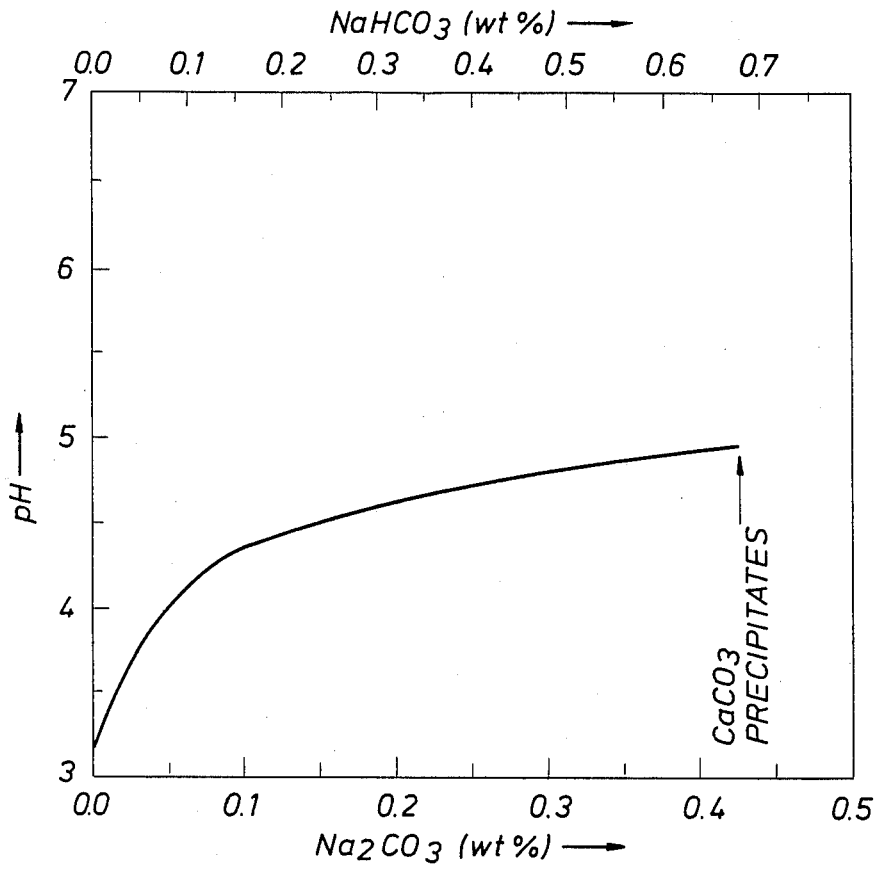
FIG. 1 shows a plot of aqueous liquid solution pH with increasing amounts of sodium bicarbonate or sodium carbonate at 170° F. and 2500 psig.

The present invention is at least in part premised on a discovery that the corrosivity of a premixed aqueous solution of carbon dioxide at the pressure and temperature of a subterranean reservoir can be significantly reduced in a relatively simple and economical manner. As indicated by the prior processes mentioned above, solutions of $CO_2$ in water have sometimes been injected into subterranean reservoirs in spite of their corrosivity; or, in condenser corrosion prevention, have been rendered alkaline by additions of relatively expensive chemicals; or, in EOR, the operators have undertaken the relatively costly and manpower-intensive procedures of (1) alternating injections of slugs of $CO_2$ and slugs of water at a frequency designed for causing mixing near the injection well and/or (2) adding corrosion inhibitors to production wells.

Although the prior processes are sometimes effective, some reservoir formations are heterogeneous or fractured or have portions which are soluble in carbonic acid as emphasized by the experiences reported in SPE 10685 and CIM 13-34-17, to an extent creating a risk of the $CO_2$ being wasted. Where the $CO_2$ is injected alternately with water, it may flow increasingly through the higher permeability zones and poorer volumetric sweep may result. These as well as other reservoirs may also be penentrated by wells containing corrosion-prone conduits.

Applicants have found the corrosivity can be significantly reduced and the likelihood of poor volumetric sweep can be avoided by injecting pre-formed carbonated water containing carbonate salt. In some sandstone reservoirs the present process also advantageously tends to reduce the driving force for clay transformations that might adversely affect oil production and/or reduce the dissolving of carbonate grain cementing material which might cause erosion due to intrusion of unconsolidated sand into the wellbores.

The reactions that take place in an aqueous solution in equilibrium with an excess $CO_2$ phase are complex. When a carbonate solution contains multivalent cations, solid phases may form. Whether solids precipitate can be determined by comparing the solubility products of the various minerals with the products of the aqueous phase concentrations of the appropriate ions. The least soluble of these is calcium carbonate. When equations for the equilibrium constants for reactions between the various ionic species are combined with a charge balance and stoichiometric relationships, they yield a cubic equation for the concentration of hydrogen ions in solution:

$$[H^+]^3+\{2[Na_2CO_3]+[NaHCO_3]\}[H^+]^2-\{K_w+K_1[H_2CO_3(app)]\}[H^+]-2K_1K_2[H_2CO_3(app)]=0$$

The solution to such an equation can be found, either analytically or by simply evaluating the polynomial as a function of $[H^+]$ to determine the pH at which it changes sign. The ions from the salts in the brine do not appear in this equation because their contributions cancel one another. The brine does play a role, however, as it affects the activities of the solutes and the apparent concentration of carbonic acid.

The values of the equilibrium constants and apparent concentration of carbonic acid used in finding the solutions to the above equation are recorded in Table 1. For this example, the brine is modeled as 30% synthetic D-sand water (DSW) because it has nearly the same salinity as seawater (see Table 2), for which the appropriate equilibrium constants have been measured and correlated. These correlations are applied directly to 30% DSW to produce the values shown in Table 1. Although 30% DSW may have more or less total dissolved solids than water available for $CO_2$ field projects, the calculations presented here should reflect aqueous carbonate equilibria in reservoir brines.

TABLE 1

Consistent with Molal Units, Values of the Equilibrium Constants and Apparent Concentration of Carbonic Acid used to Determine the pH of Carbonated, 30% D-sand Water to which $Na_2CO_3$ or $NaHCO_3$ is added

| Quantity | Value @ 170° F. 2500 psig | Value @ 77° F. 14.7 psig |
|---|---|---|
| $-\log K_w$ | 11.9 | 13.2 |
| $-\log K_1$ | 6.0 | 5.95 |
| $-\log K_2$ | 8.51 | 9.04 |
| $-\log K_{sp}^{CaCO_3}$ | 6.57 | 6.19 |
| $[H_2CO_3(app)]$ | 0.865 | 0.012 |

TABLE 2

Comparison of Concentrations of Major Inorganic Species in Seawater and in 30% Synthetic D-sand Water

| Species | Concentration in 30% Synthetic DSW (ppm) | Concentration in Seawater (ppm) |
|---|---|---|
| $Cl^-$ | 21,900 | 19,000 |
| $Na^+$ | 12,900 | 10,600 |
| $Ca^{2+}$ | 500 | 400 |
| $Mg^{2+}$ | 390 | 1,300 |

FIG. 1 displays the pH of a solution of 30% D-sand water in equilibrium with a free $CO_2$ phase at 170° F., 2500 psig as a function of $Na_2CO_3$ or $NaHCO_3$ content. This is representative of such a solution under reservoir conditions as a function of the amount of $Na_2CO_3$ or $NaHCO_3$ added. The pH rises quickly when $Na_2CO_3$ is included. This is because $Na^+$ is being substituted for $H^+$ in satisfying the charge balance. Whether $Na_2CO_3$ or $NaHCO_3$ is incorporated, however, makes little difference on the pH of the system; it is the equivalents of $Na^+$ that counts. Thus, the ratio of $NaHCO_3$ to $Na_2CO_3$ needed to achieve a given pH is equal to twice the ratio of the molecular weights.

There is one difference between $Na_2CO_3$ and $NaHCO_3$. The solution takes up $CO_2$ to maintain equilibrium with the free $CO_2$ phase when $Na_2CO_3$ is added. By contrast, $CO_2$ evolves from the solution when $NaHCO_3$ is used. In either case, the amount of $CO_2$ is small, corresponding to less than 5 SCF/bbl of solution for the concentration range depicted in FIG. 1.

For this example, the solubility product of $CaCO_3$ is exceeded when the concentrations of $Na_2CO_3$ and $NaHCO_3$ reach approximately 0.42 wt% and 0.67 wt%, respectively. To keep $CaCO_3$ from precipitating, the concentrations of the additives must be below these values. The amounts that can be added decrease as the hardness increases.

The equilibrium state differs greatly at surface conditions, e.g., 77° F. and low pressure. In particular, calcium carbonate precipitates from the solution at lower levels of $Na_2CO_3$ or $NaHCO_3$.

If a free $CO_2$ phase (or a $CO_2$-rich phase) is not present, as would ordinarily be the case in surface facilities, $CaCO_3$ drops out of the 30% DSW solution, at a pH slightly below 9, when only 0.0012 wt% $Na_2CO_3$ has been added. The case of adding $NaHCO_3$ is somewhat better: 0.0168 wt% can be incorporated before $CaCO_3$ precipitates (solution pH of 7.5). Nevertheless, neither of these chemicals can be added in quantities sufficient to raise the solution pH appreciably under reservoir conditions, as indicated in FIG. 1.

Figure 2:
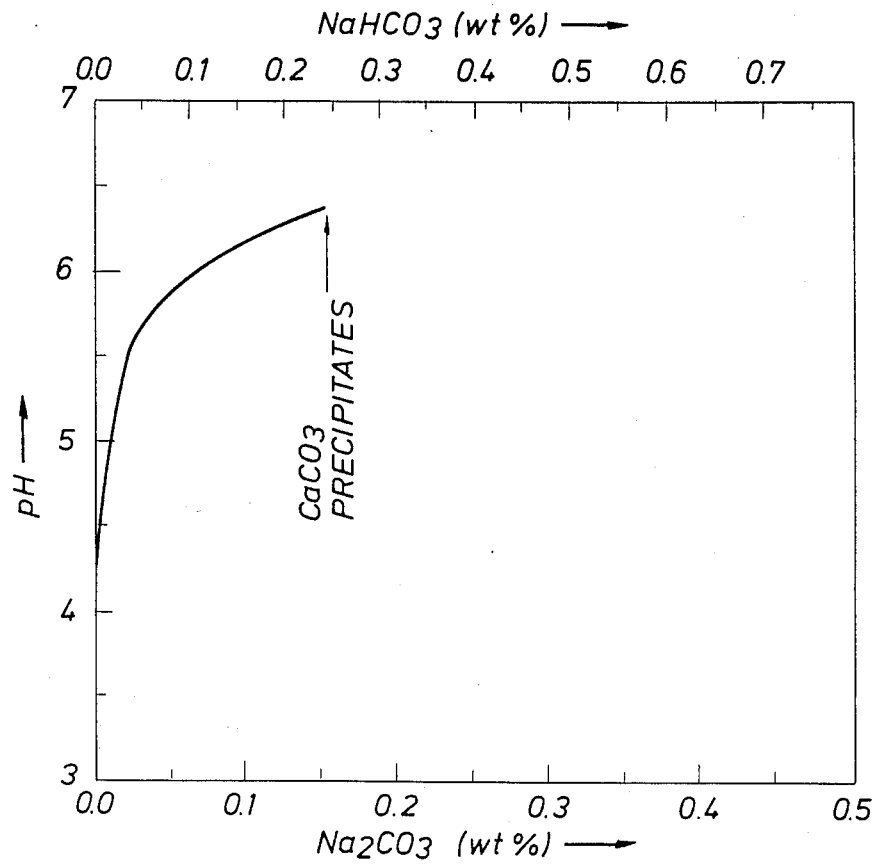
FIG. 2 shows a similar plot at 77° F. and 14.7 psia.

A way to keep calcium carbonate from precipitating in surface facilities is to store the solution under a blanket of $CO_2$. The partial pressure of the $CO_2$ can be relatively low. FIG. 2 displays the calculation of solution pH as a function of the $Na_2CO_3$ or $NaHCO_3$ content when the partial pressure of $CO_2$ is one atmosphere. 0.15 wt% $Na_2CO_3$ or 0.24 wt% $NaHCO_3$ can be added to the brine before $CaCO_3$ drops out. (Even more $Na_2CO_3$ or $NaHCO_3$ can be included if the partial pressure of $CO_2$ is higher.) These amounts give a pH of about 4.5 under reservoir conditions (see FIG. 1).

The saline aqueous solution (or water or brine) which is used in the present process can be substantially any which can be flowed through the reservoir to be treated without significant change due to dilution and/or increases in salinity due to diffusion and/or ion-exchange effects within the reservoir. Such a brine is preferably the brine produced from the reservoir to be treated or produced from a nearby reservoir. When the reservoir has been waterflooded with a brine less saline than the reservoir brine, the brine used in the present process preferably has a salinity which is substantially equivalent in the effective ratio of monovalent to multivalent cations relative to the brine used in the waterflood after it reached a state of equilibrium with the rocks in the reservoir.

The monovalent cationic salt of carbonic acid which is used in the present process can comprise substantially any alkali metal or ammonium salt. Sodium carbonate, sodium bicarbonate, or mixtures of them, are particularly preferred for such use.

What is claimed is:

1. In a process in which a mixture of an aqueous liquid and $CO_2$ is injected into a subterranean reservoir, an improvement for reducing the adverse effects of the resultant carbonic acid, comprising:

dissolving in the aqueous liquid with which the $CO_2$ is mixed, an amount of monovalent cationic salt of carbonic acid sufficient for providing a pH of at least about 4 but is less than enough to cause precipitation of carbonate salts at the pressure and temperature of the reservoir; and injecting the preformed mixture into the reservoir.

2. The process of claim 1 in which the monovalent cationic salt is an alkali metal salt.

3. The process of claim 1 in which the aqueous liquid is a liquid produced from the reservoir being treated.

4. The process of claim 1 in which the monovalent cationic salt is sodium bicarbonate.

5. The process of claim 1 in which the monovalent cationic salt is sodium carbonate.

6. In a process in which a mixture of an aqueous liquid and $CO_2$ is injected into a subterranean reservoir to enhance oil recovery, an improvement for reducing the adverse effects of the resultant carbonic acid, comprising:

dissolving in the aqueous liquid with which the $CO_2$ is mixed, an amount of monovalent alkali metal salt of carbonic acid that is sufficient to provide a pH of at least about 4, but insufficient to cause precipitation of multivalent carbonate salts under reservoir conditions;

injecting the mixture into the reservoir; and producing oil from the reservoir.

7. The process of claim 6 in which the monovalent alkali metal salt is sodium bicarbonate.

8. The process of claim 6 in which the monovalent alkali metal salt is sodium carbonate.

9. In a process in which injections of aqueous liquid into a subterranean reservoir are alternated with injections of $CO_2$ into the subterranean reservoir to enhance oil recovery, an improvement for reducing the adverse effects of the resultant carbonic acid, comprising:

dissolving in the aqueous liquid to be injected into the reservoir an amount of monovalent alkali metal salt of carbonic acid that is sufficient to provide a pH of at least about 4, but insufficient to cause precipitation of multivalent carbonate salts under reservoir conditions; and injecting the aqueous liquid into the reservoir; and producing oil from the reservoir.

10. The process of claim 9 in which the monovalent alkali metal salt is sodium bicarbonate.

11. The process of claim 9 in which the monovalent alkali metal salt is sodium carbonate.

12. A process for preparing a brine solution in which divalent cations are present, that solution being effective for increasing the pH of said brine solution under reservoir conditions in a $CO_2$ flooding operation comprising:

maintaining a blanket of $CO_2$ on the brine solution; and dissolving in the brine solution an amount of monovalent cationic carbonic acid salt which is sufficient to increase the brine solution pH under reservoir conditions and effective to reduce adverse mineral transformations within the reservoir.

13. The process of claim 12 wherein the blanket of $CO_2$ is present at about one atmosphere.

14. The process of claim 12 wherein the monovalent cationic carbonic acid salt is an alkali metal salt.

15. The process of claim 12 wherein the monovalent cationic carbonic acid salt is a bicarbonate salt.

16. The process of claim 12 wherein the monovalent cationic carbonic acid salt is selected from the group consisting of sodium carbonate, sodium bicarbonate, and mixtures thereof.

17. A process for preparing a brine solution in which divalent cations are present, that solution being effective for increasing the pH of said brine solution under reservoir conditions in a $CO_2$ flooding operation comprising:

maintaining a blanket of $CO_2$ on the brine solution, said blanket of $CO_2$ present at about one atmosphere; and dissolving in the brine an amount of monovalent cationic carbonic acid salt which is sufficient to increase the brine pH under reservoir conditions and effective to reduce adverse mineral transformations within the reservoir.

* * * * *